US010587944B2

(12) United States Patent
Yu

(10) Patent No.: US 10,587,944 B2
(45) Date of Patent: Mar. 10, 2020

(54) EARPHONE STORAGE DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Pan Yu, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/785,502

(22) Filed: Oct. 17, 2017

(65) Prior Publication Data

US 2019/0075386 A1 Mar. 7, 2019

(30) Foreign Application Priority Data

Sep. 1, 2017 (CN) ..... 2017 1 0781141

(51) Int. Cl.
*B65D 85/672* (2006.01)
*B65H 75/16* (2006.01)
(Continued)

(52) U.S. Cl.
CPC ..... *H04R 1/1033* (2013.01); *B65D 85/672* (2013.01); *B65H 75/16* (2013.01); *B65H 75/406* (2013.01)

(58) Field of Classification Search
CPC ..... H04R 1/1033; H04R 1/105; H04R 1/10; H04R 1/1066; B65D 85/672; B65D 85/04; B65D 21/02; B65D 21/0201; B65D 21/033; B65D 25/16; B65D 85/00; B65D 85/08; B65D 85/67; B65D 25/10; B65D 25/02; B65D 25/04; B65D 25/18; B65D 21/0233;
(Continued)

(56) References Cited

U.S. PATENT DOCUMENTS 6,206,318 B1 * 3/2001 Glass ..... B65H 75/4476 242/400.1
2004/0178313 A1 * 9/2004 Oren ..... A47B 96/061 248/316.7

(Continued)

FOREIGN PATENT DOCUMENTS

CN 202353781 * 7/2012 ..... H04R 1/10
CN 205793146 * 7/2016 ..... H04R 1/10

*Primary Examiner* — Rafael A Ortiz
(74) *Attorney, Agent, or Firm* — ScienBiziP, P.C.

(57) ABSTRACT

An earphone storage device includes a storage body having a bobbin, a track, and two sliders. The bobbin has a peripheral surface, an upper surface, a lower surface, a helical groove, and a protrusion. The helical groove is formed on the peripheral surface. The protrusion extends from the lower surface. The protrusion has a side surface and a hole formed in the side surface. The track is secured to the upper surface of the bobbin. The sliders are disposed on the track. The storage body stores earphones with an audio plug, earphone cords, and a pair of earbuds. The audio plug is inserted into the hole of the protrusion of the bobbin, the earphone cords are wound in the helical groove of the bobbin, and the earbuds are held by the sliders. The earphones can be securely stored, and the earphone cords do not tangle.

13 Claims, 7 Drawing Sheets

(51) Int. Cl.
*B65H 75/40* (2006.01)
*H04R 1/10* (2006.01)

(58) Field of Classification Search
CPC ..... B65D 55/02; B65H 75/16; B65H 75/406; B65H 18/28; B65H 75/44; B65H 75/4434; B65H 75/02; A45C 11/00; A45C 11/38; E05B 73/0023
USPC ..... 206/53, 702, 37, 38, 389, 225, 223, 226, 206/216, 320, 398, 1.5, 5.1, 408, 419, 206/420; 220/23.89, 23.87, 23.83, 225, 220/226, 223, 216, 398, 320; 211/13.1, 211/26, 60.1; 252/587; 242/385.2; 248/70, 298.1, 316.7
See application file for complete search history.

(56) References Cited

U.S. PATENT DOCUMENTS

2005/0199512 A1* 9/2005 Davidson ..... A45F 5/02 206/37
2013/0153701 A1* 6/2013 Huang ..... B65H 75/4434 242/385.2
2016/0044400 A1* 2/2016 Desautels ..... H04R 1/1033 242/587

* cited by examiner

EARPHONE STORAGE DEVICE

CROSS REFERENCE TO RELATED APPLICATION

This application claims priority to Chinese Patent Application No. 201710781141.5, filed on Sep. 1, 2017, the disclosure of which is incorporated herein by reference in its entirety.

FIELD

The present disclosure relates to earphones, and more particularly to a storage device for earphones.

BACKGROUND

Earphones are worn on user's ears, and convert electrical signals to sound in the user's ears. Earphones include a pair of earbuds, an audio plug, and earphone cords. The earphone cords connect the earbuds and the audio plug. However, earphone cords are often long and tend to tangle such that knots and damage may occur.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
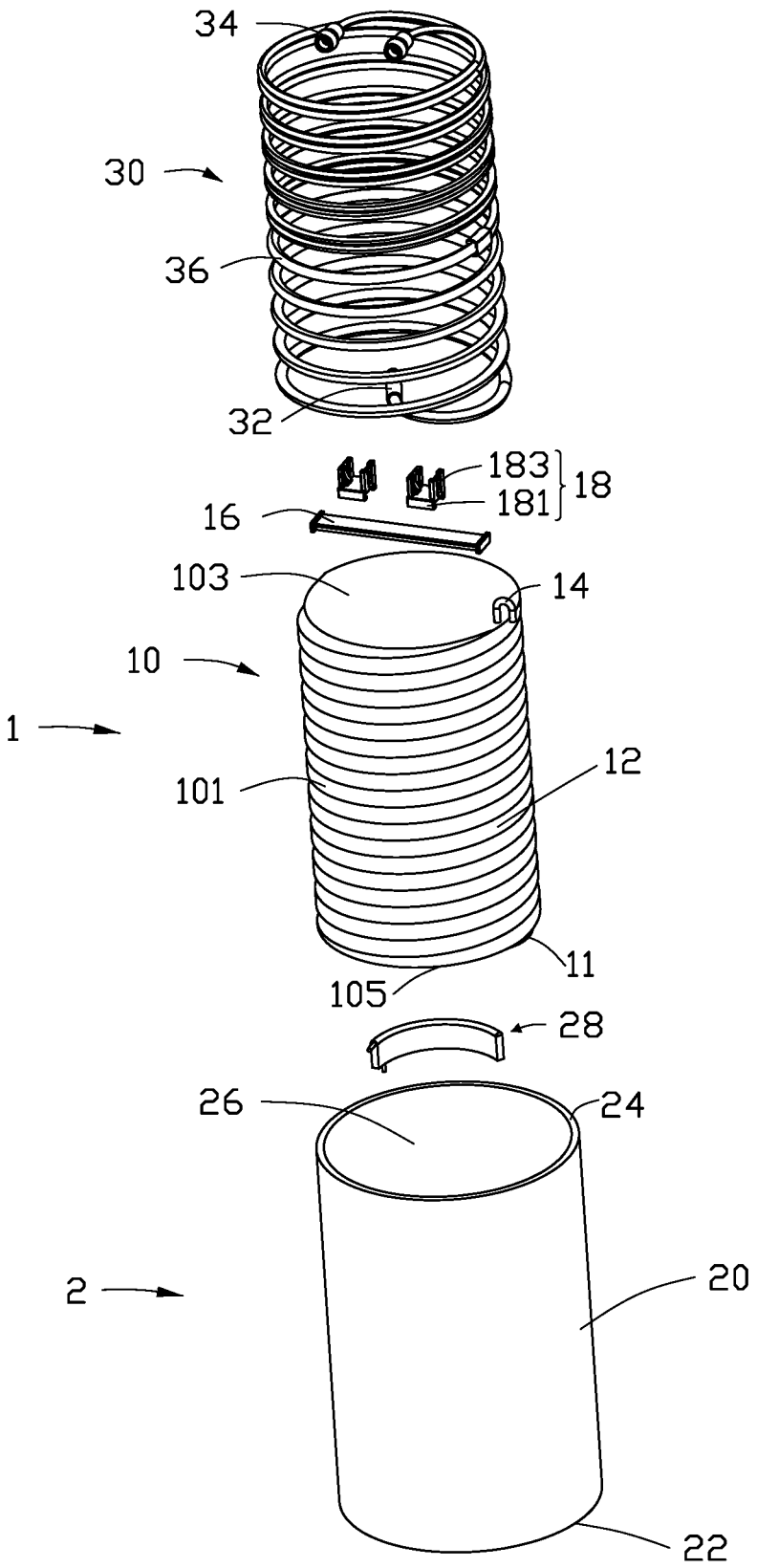
FIG. 1 is a schematic exploded top perspective view of an earphone storage device with earphones.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

With reference to FIG. 1, an exemplary embodiment of an earphone storage device includes a storage body 1 and a housing 2.

Figure 2:
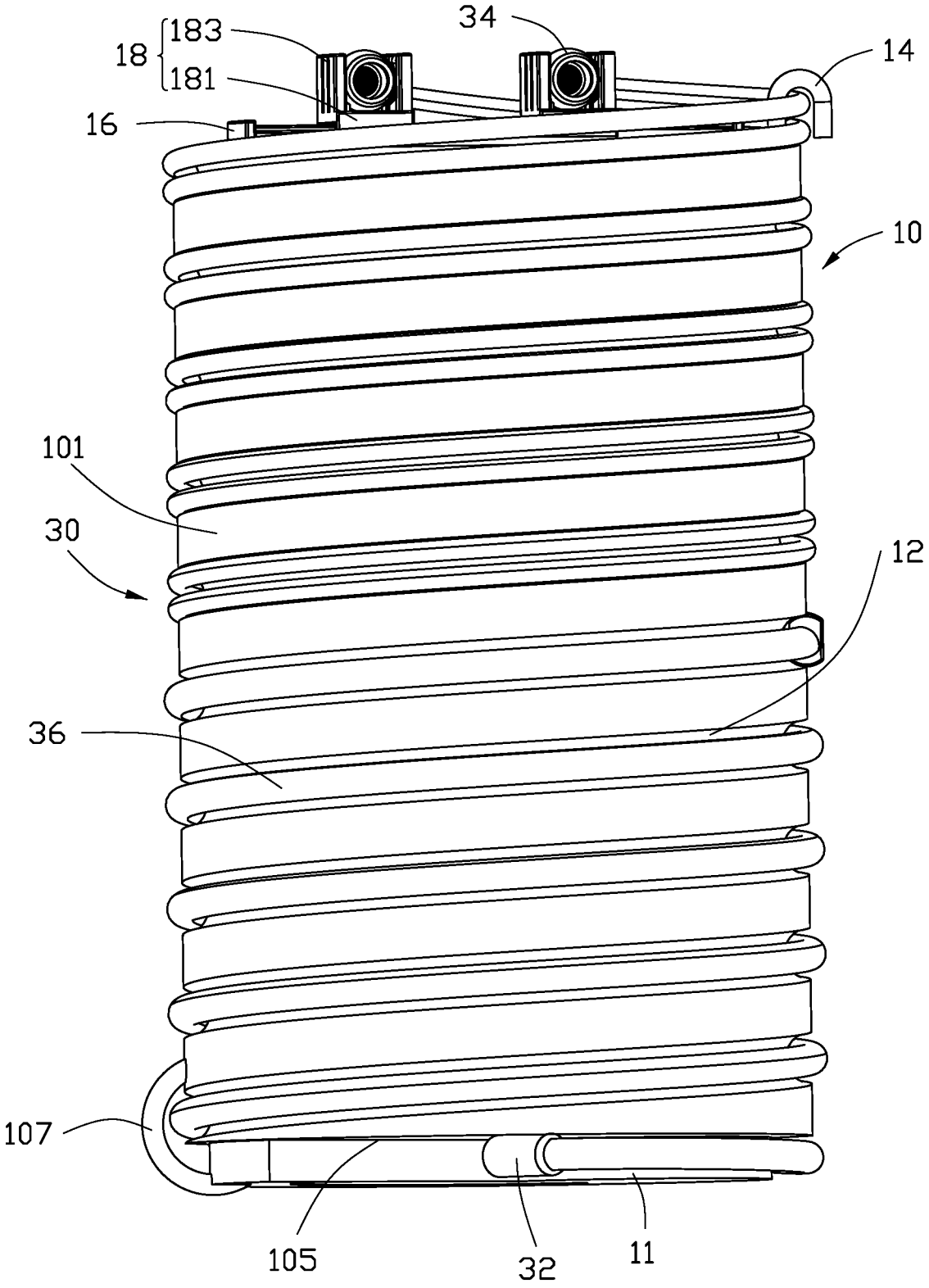
FIG. 2 is a schematic top perspective view of the earphone storage device of FIG. 1 without a housing.
Figure 3:
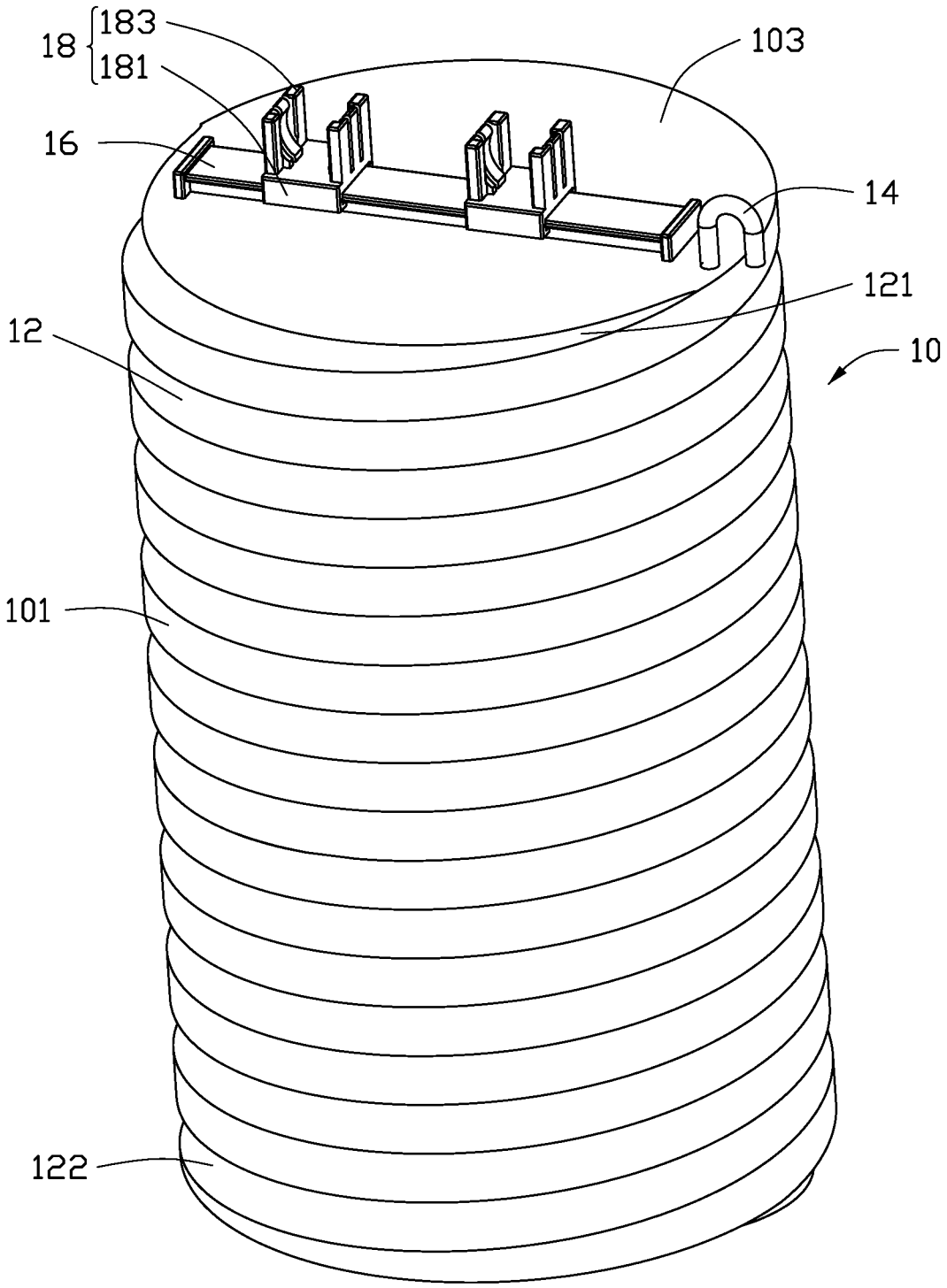
FIG. 3 is a schematic top perspective view of the earphone storage device of FIG. 1 without the housing and the earphones.
Figure 4:
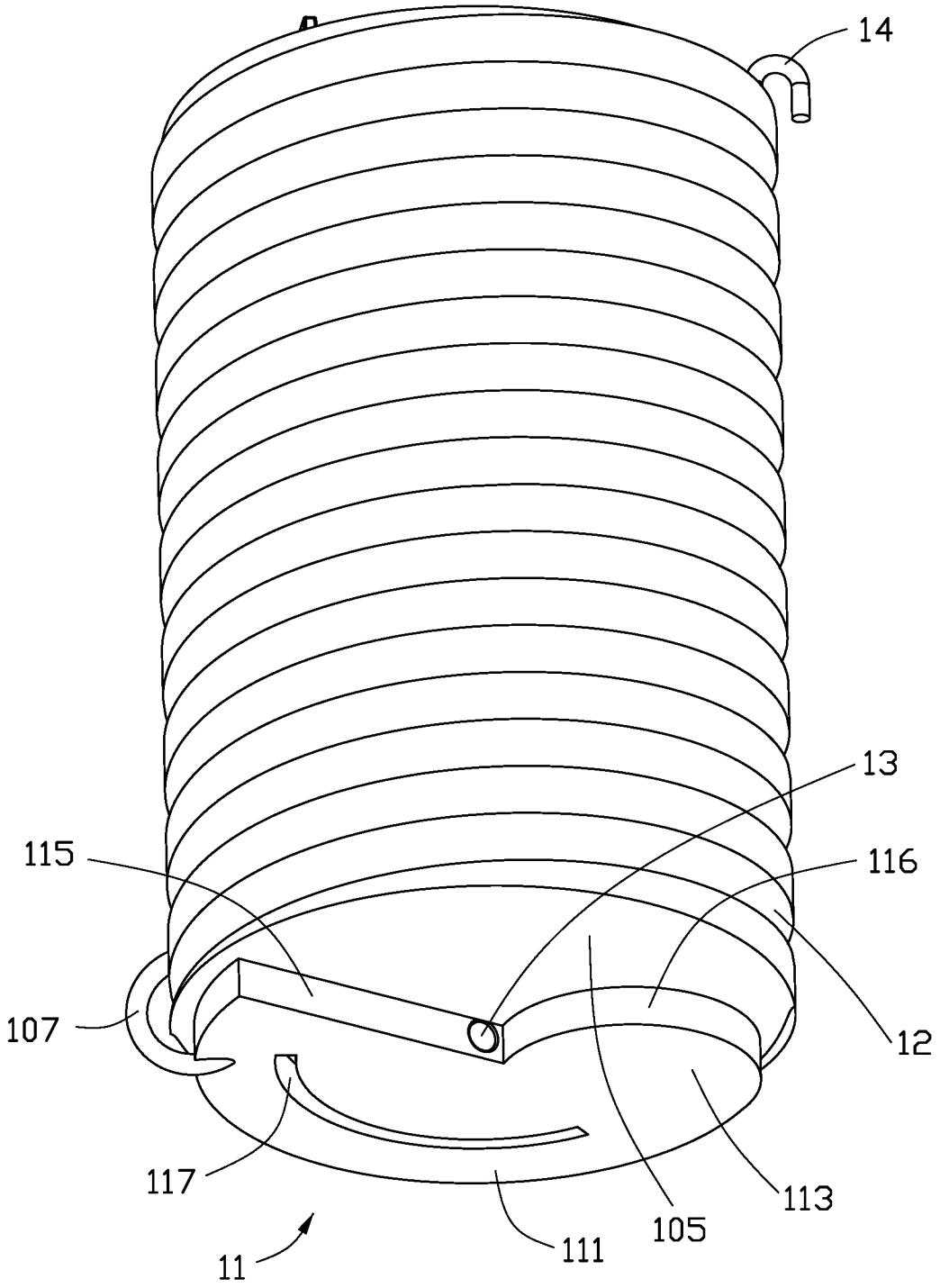
FIG. 4 is a schematic bottom perspective view of the earphone storage device of FIG. 1 without the housing and the earphones.
Figure 7:
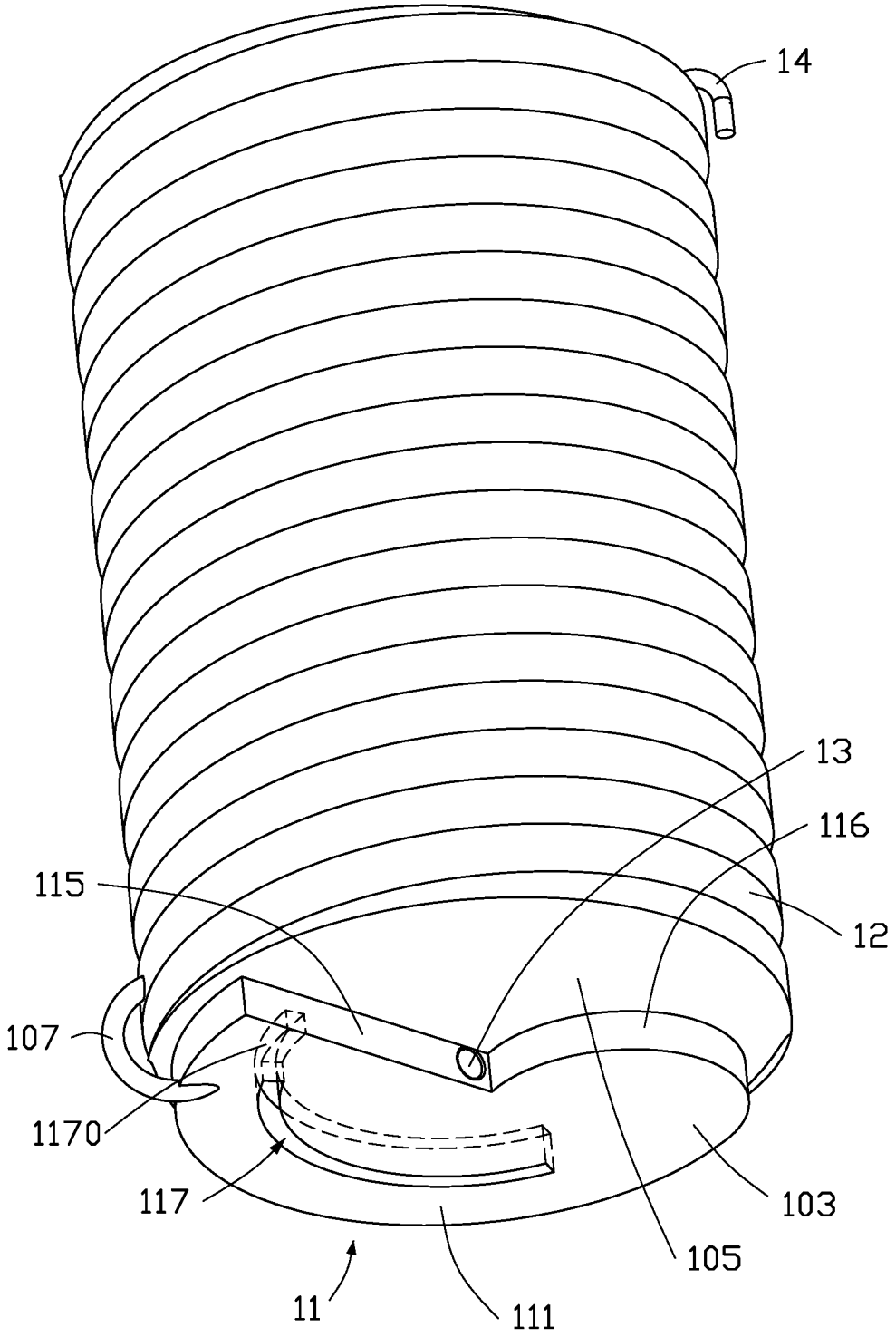
FIG. 7 is a schematic bottom perspective view of a rocking recess of a bobbin of the earphone storage device of FIG. 1.

With reference to FIGS. 2-3, the storage body 1 includes a bobbin 10, a hook 14, a track 16, two sliders 18, and a connecting ring 107. The bobbin 10 is cylindrical, and has a peripheral surface 101, an upper surface 103, a lower surface 105, a helical groove 12, and a protrusion 11. The helical groove 12 is formed on the peripheral surface 101. The helical groove 12 has an upper end 121 and a lower end 122. The upper end 121 extends to the upper surface 103 and the lower end 122 extends to the lower surface 105. With further reference to FIG. 4, the protrusion 11 extends from the lower surface 105. The protrusion 11 has a first semi-circular portion 111, a second semi-circular portion 113, a planar side surface 115, a curved side surface 116, a bottom surface, a hole 13, and a locking groove 117. The first semi-circular portion 111 has a diameter greater than a diameter of the second semi-circular portion 113. The hole 13 is formed in the planar side surface 115 adjacent to the second semi-circular portion 113. The locking groove 117 is curved, and is formed in the bottom surface. A locking recess 1170 (as shown in FIG. 7) is located at an end of the locking groove 117. The hook 14 is secured to the upper surface 103 of the bobbin 10 and corresponds to the upper end 121 of the helical groove 12. The track 16 is secured to the upper surface 103 of the bobbin 10. The sliders 18 are arranged side by side on the track 16. Each slider 18 has a base 181 and a resilient clip 183. The base 181 is slidably mounted on the track 16. The resilient clip 183 is secured to the base 181. The connecting ring 107 is secured to the bobbin 10 adjacent to the lower surface 105. The connecting ring 107 can be attached to a key ring or the like to facilitate carrying the bobbin 10.

With reference to FIGS. 1-2, the storage body 1 is used to store earphones 30. The earphones 30 include an audio plug 32, earphone cords 36, and a pair of earbuds 34. With further reference to FIG. 4, the audio plug 32 is inserted into the hole 13 of the protrusion 11 of the bobbin 10. The earphone cords 36 are wound along the curved side surface 116 of the protrusion 11 of the bobbin 10 and then wound in the helical groove 12 of the bobbin 10. The earphone cords 36 have a main cord and left and right cords. The left and right cords at the upper end 121 of the helical groove 12 engage the hook 14, to prevent separation thereof. The earbuds 34 are held by the resilient clips 183 of the sliders 18. The resilient clips 183 allow the earbuds 34 to be easily put in and taken out. The sliders 18 can be slid and adjusted in accordance with the length of the earphone cords 36. Therefore, the earphones 30 can be securely stored as shown in FIG. 2, and the earphone cords 36 do not tangle.

Figure 5:
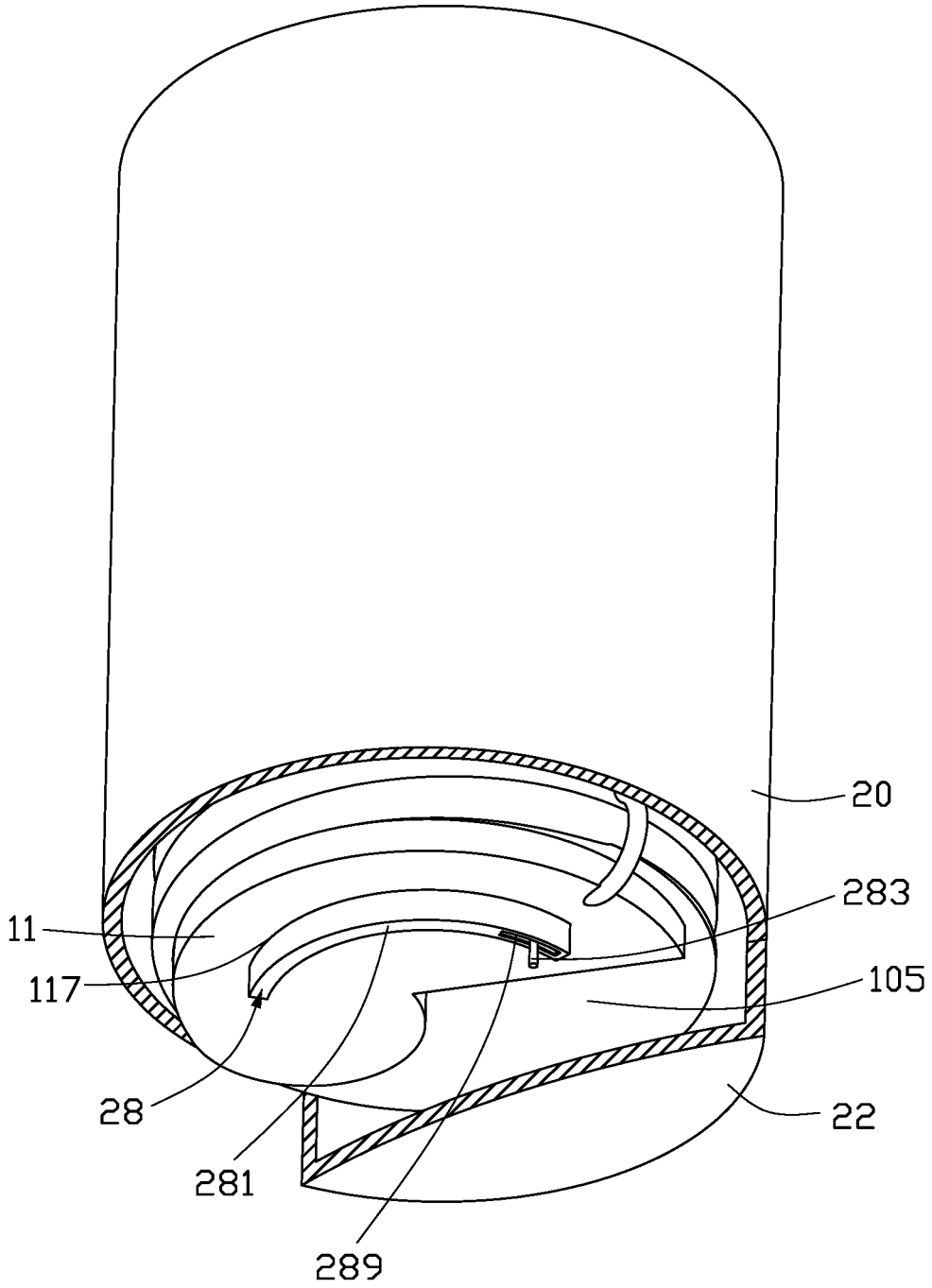
FIG. 5 is a schematic bottom perspective view in partial section of the earphone storage device of FIG. 1 without the earphones.
Figure 6:
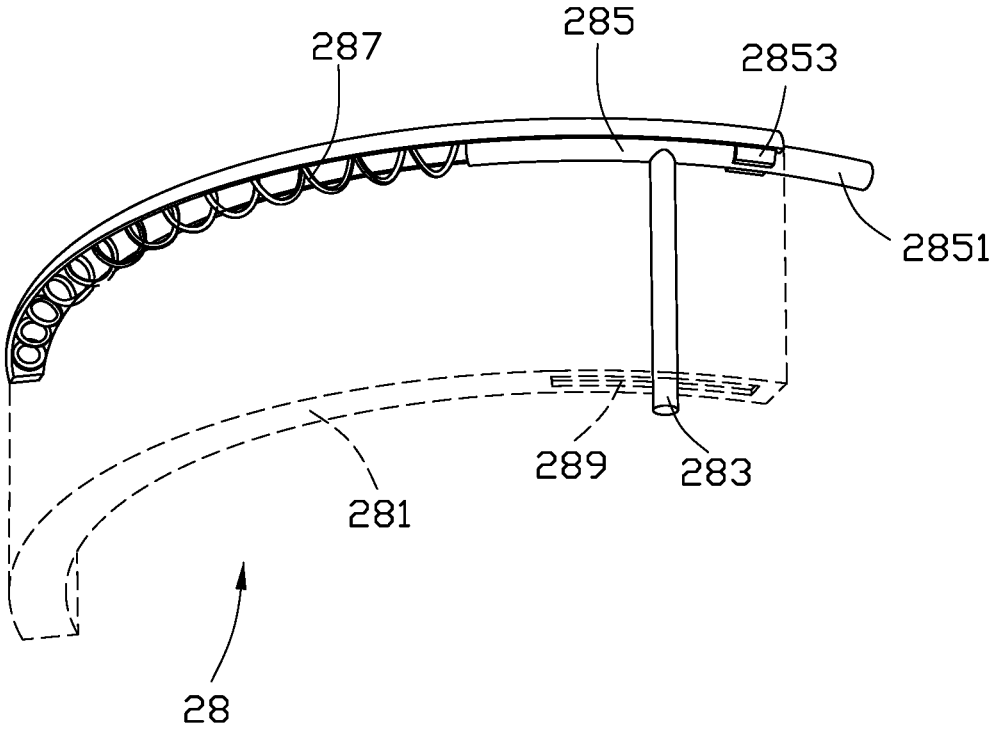
FIG. 6 is a schematic bottom perspective view of a locking assembly of the housing of the earphone storage device of FIG. 1.

With reference to FIGS. 1 and 5, the housing 2 includes a cylindrical sleeve 20 and a latching assembly 28. The sleeve 20 has an open end 24, a semi-closed end 22, and a receiving chamber 26. The sleeve 20 covers the bobbin 10. The lower surface 105 of the bobbin 10 faces the semi-closed end 22 of the sleeve 20. The latching assembly 28 is mounted on the semi-closed end 22 of the sleeve 20. The latching assembly 28 is protruded from the semi-closed end 22 toward the receiving chamber 26. The latching assembly 28 can lock the bobbin 10 in the sleeve 20. With further reference to FIG. 6, the latching assembly 28 has an insert member 281, a moving member, a resilient member 287, and a limiting ring 2853. The insert member 281 is curved and can be inserted into the locking groove 117 of the protrusion 11 of the bobbin 10. The insert member 281 has an internal chamber, a bottom wall, and a guide slot 289. The guide slot 289 is formed in the bottom wall and communicates with the internal chamber. The moving member is disposed in the insert member 281. The moving member is T-shaped and has a latch arm 285 and a control arm 283. The latch arm 285 has an abutting end and an engaging end 2851. The engaging end 2851 of the latch arm 285 protrudes out of the insert member 281. The control arm 283 is movable along the guide slot 289 of the insert member 281. The control arm 283 has an inner end and an outer end. The inner end of the control arm 283 connects to the latch arm 285. The outer end of the control arm 283 protrudes out of the insert member 281 and the semi-closed end 22 of the sleeve 20. The resilient member 287 is disposed in the insert member 281. The resilient member 287 abuts the abutting end of the latch arm 285 such that the engaging end 2851 of the latch arm 285 can protrude out of the insert member 281. The limiting ring 2853 is mounted around the latch arm 285 adjacent to the engaging end 2851 and is disposed in the insert member 281. The limiting ring 2853 limits a protruding length of the engaging end 2851 from the insert member 281.

When the housing 2 is desired to cover the bobbin 10, the end of the control arm 283 that is protruding from the closed end 22 of the sleeve 20 is moved along the guide slot 289 to cause the engaging end 2851 of the latch arm 285 to retract into the insert member 281, and to compress the resilient member 287 to store energy. The insert member 281 is then inserted into the locking groove 117 of the protrusion 11 of the bobbin 10, and the bobbin 10 is received in the sleeve 20. When the control arm 283 is released, the engaging end 2851 of the latch arm 285 is pushed out of the insert member 281 by the energy stored in the resilient member 287, so forcing the locking recess of the bottom side of the locking groove 117 to fasten the engaging end 2851. Then, the bobbin 10 is stably received in the sleeve 10. And the housing 2 can thereby securely cover the bobbin 10 to protect the earphones 30 on the bobbin 10. When the protruding end of the control arm 283 is again moved along the guide slot 289 to cause the engaging end 2851 of the latch arm 285 to retract and disengage from the locking recess, the housing 2 can be removed from the bobbin 10 and the earphones 30 can be taken out.

In the present exemplary embodiment, the earphone storage device is substantially cylindrical and has a diameter of approximately 30 mm and a height of approximately 100 mm.

The exemplary embodiments shown and described above are only examples. Many details are often found in the art such as the other features of an earphone storage device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. An earphone storage device comprising a storage body having:

a bobbin having:

an upper surface;

a lower surface;

a protrusion extending from the lower surface, and the protrusion having a locking groove, and the locking groove is curved;

a locking recess is located at an end of the locking groove;

a housing having a sleeve, and the sleeve covering the bobbin and having an open end, a semi-closed end, and a receiving chamber, wherein the housing has a latching assembly, the latching assembly is mounted on the semi-closed end of the sleeve, and the latching assembly is protruded from the semi-closed end toward the receiving chamber;

wherein the latching assembly has:

an insert member having:

an internal chamber;

a bottom wall; and a guide slot formed in the bottom wall and communicating with the internal chamber;

a moving member disposed in the insert member, and the moving member having:

a latch arm having an abutting end and an engaging end; and a control arm movable along the guide slot of the insert member, the control arm having an inner end and an outer end, the inner end connecting to the latch arm, and the outer end protruding out of the insert member and the semi-closed end of the sleeve; and a resilient member disposed in the insert member;

wherein the outer end of the control arm is moved along the guide slot to cause the engaging end of the latch arm to retract into the insert member, and to compress the resilient member to store energy, and the insert member is then inserted into the locking groove of the protrusion of the bobbin, when the control arm is released, the engaging end of the latch arm is pushed out of the insert member by the energy stored in the resilient member, to engage the locking recess at the end of the locking groove, and the latching assembly locks the bobbin in the sleeve.

2. The earphone storage device of claim 1, wherein the bobbin further has a peripheral surface, and a helical groove formed on the peripheral surface, and the helical groove having:

an upper end extending to the upper surface; and a lower end extending to the lower surface;

the storage body further has a hook, and the hook is secured to the upper surface of the bobbin and corresponds to the upper end of the helical groove.

3. The earphone storage device of claim 1, wherein the protrusion having a side surface and a hole formed in the side surface;

a track secured to the upper surface of the bobbin;

two sliders disposed on the track;

the sliders are arranged side by side on the track, and each slider has:

a base slidably mounted on the track; and a resilient clip secured to the base.

4. The earphone storage device of claim 2, wherein the protrusion having a side surface and a hole formed in the side surface;

a track secured to the upper surface of the bobbin;

two sliders disposed on the track;

the two sliders are arranged side by side on the track, and each slider has:

a base slidably mounted on the track; and a resilient clip secured to the base.

5. The earphone storage device of claim 1, wherein the protrusion of the bobbin has a first semi-circular portion, a second semi-circular portion, and a curved side surface, and the first semi-circular portion has a diameter greater than a diameter of the second semi-circular portion.

6. The earphone storage device of claim 2, wherein the protrusion of the bobbin has a first semi-circular portion, a second semi-circular portion, and a curved side surface, and the first semi-circular portion has a diameter greater than a diameter of the second semi-circular portion.

7. The earphone storage device of claim 3, wherein the protrusion of the bobbin has a first semi-circular portion, a second semi-circular portion, and a curved side surface, and the first semi-circular portion has a diameter greater than a diameter of the second semi-circular portion.

8. The earphone storage device of claim 5, wherein the side surface of the protrusion of the bobbin is flat, and the hole formed in the side surface is located adjacent to the second semi-circular portion.

9. The earphone storage device of claim 6, wherein the side surface of the protrusion of the bobbin is flat, and the hole formed in the side surface is located adjacent to the second semi-circular portion.

10. The earphone storage device of claim 7, wherein the side surface of the protrusion of the bobbin is flat, and the hole formed in the side surface is located adjacent to the second semi-circular portion.

11. The earphone storage device of claim 1, wherein the lower surface of the bobbin faces the semi-closed end of the sleeve; and wherein the storage body further has a connecting ring secured to the bobbin adjacent to the lower surface.

12. The earphone storage device of claim 2, wherein the lower surface of the bobbin faces the semi-closed end of the sleeve; and wherein the storage body further has a connecting ring secured to the bobbin adjacent to the lower surface.

13. The earphone storage device of claim 11, wherein the latching assembly further has a limiting ring, the limiting ring is mounted around the latch arm adjacent to the engaging end and is disposed in the insert member, and the limiting ring limits a protruding length of the engaging end from the insert member.

* * * * *